US009084056B2

(12) United States Patent
Flavignard et al.

(10) Patent No.: US 9,084,056 B2
(45) Date of Patent: Jul. 14, 2015

(54) COAXIAL SPEAKER SYSTEM HAVING A COMPRESSION CHAMBER WITH A HORN

(75) Inventors: Yoann Flavignard, Chartrettes (FR); Philippe Lesage, Chartrettes (FR); Arthur Leroux, Paris (FR); Nicolas Clevy, Paris (FR); Jean-Louis Tebec, Gif-sur-Yvette (FR); Benedicte Hayne, Paris (FR)

(73) Assignee: PHL AUDIO, Chartrettes (FR)

( * ) Notice: Subject to any disclaimer, the term of this patent is extended or adjusted under 35 U.S.C. 154(b) by 0 days.

(21) Appl. No.: 13/522,249

(22) PCT Filed: Jan. 14, 2011

(86) PCT No.: PCT/FR2011/000023
§ 371 (c)(1),
(2), (4) Date: Dec. 7, 2012

(87) PCT Pub. No.: WO2011/086300
PCT Pub. Date: Jul. 21, 2011

(65) Prior Publication Data

US 2013/0121522 A1 May 16, 2013

(30) Foreign Application Priority Data

Jan. 15, 2010 (FR) ..... 10 00154

(51) Int. Cl.
*H04R 25/00* (2006.01)
*H04R 1/32* (2006.01)
(Continued)

(52) U.S. Cl.
CPC ..... *H04R 1/323* (2013.01); *H04R 1/24* (2013.01); *H04R 1/30* (2013.01); *H04R 9/027* (2013.01); *H04R 9/063* (2013.01)

(58) Field of Classification Search
CPC ..... H04R 1/30; H04R 1/345; H04R 1/24; H04R 1/26; H04R 1/22; H04R 9/02; H04R 9/063; H04R 1/20; H04R 1/2811; H04R 1/2888; H04R 1/403; H04R 2201/34; H04R 2207/021; H04R 2209/043; H04R 2307/029
USPC ..... 381/340, 343, 150, 396, 398, 401, 402, 381/403, 412, 419, 420, 421, 337, 338, 339
See application file for complete search history.

(56) References Cited

U.S. PATENT DOCUMENTS 1,631,646 A 6/1927 Rice
1,707,545 A 4/1929 Wente
(Continued)

FOREIGN PATENT DOCUMENTS

DE 102 07 561 C1 7/2003
DE 102 11 086 A1 10/2003
(Continued)

OTHER PUBLICATIONS

International Search Report of PCT/FR2011/000024, dated Apr. 20, 2011.
(Continued)

*Primary Examiner* — Davetta W Goins
*Assistant Examiner* — Phylesha Dabney
(74) *Attorney, Agent, or Firm* — Sughrue Mion, PLLC

(57) ABSTRACT

Coaxial two-way or more loudspeaker system (1) comprising a low range electro-dynamic transducer (2) and a high range transducer (3) with compression chamber including a whole horn, mounted in a coaxial and frontal with respect of the low range transducer (2).

5 Claims, 6 Drawing Sheets

(51) Int. Cl.

| | |
|---|---|
| ***H04R 1/24*** | (2006.01) |
| ***H04R 1/30*** | (2006.01) |
| *H04R 9/02* | (2006.01) |
| *H04R 9/06* | (2006.01) |

(56) References Cited

U.S. PATENT DOCUMENTS

| | | | | |
|---|---|---|---|---|
| 1,707,570 | A | 4/1929 | Rice | |
| 1,766,473 | A | 6/1930 | Wente | |
| 1,907,723 | A | 5/1933 | Bostwick | |
| 1,930,915 | A | 10/1933 | Wente | |
| 2,037,187 | A | 4/1936 | Wente | |
| 2,269,284 | A | 1/1942 | Olson | |
| 2,442,791 | A | 6/1948 | Wente | |
| 2,490,466 | A | 12/1949 | Olson et al. | |
| 3,328,537 | A | 6/1967 | Hecht | |
| 3,991,286 | A | 11/1976 | Henricksen | |
| 4,164,631 | A | 8/1979 | Garner et al. | |
| 4,256,930 | A | 3/1981 | Garner et al. | |
| 4,283,606 | A | 8/1981 | Buck | |
| 4,532,383 | A | 7/1985 | Willy | |
| 4,933,975 | A | 6/1990 | Button | |
| 4,965,839 | A | 10/1990 | Elieli | |
| 5,018,206 | A | 5/1991 | Suzuki | |
| 5,042,072 | A | 8/1991 | Button | |
| 5,181,253 | A | 1/1993 | Jordan | |
| 5,471,437 | A | 11/1995 | Schutter et al. | |
| 5,475,765 | A | 12/1995 | Lyth | |
| 5,602,930 | A | 2/1997 | Walton | |
| 5,872,339 | A * | 2/1999 | Hanson | 181/144 |
| 6,208,743 | B1 | 3/2001 | Marten et al. | |
| 6,269,168 | B1 | 7/2001 | Tagami | |
| 6,647,122 | B1 | 11/2003 | Jones | |
| 6,792,125 | B1 | 9/2004 | David et al. | |
| 6,922,477 | B1 | 7/2005 | Ikeyama | |
| 6,963,650 | B2 | 11/2005 | Combest | |
| 7,035,424 | B1 | 4/2006 | Brandt | |
| 7,057,314 | B2 | 6/2006 | Moro | |
| 7,319,772 | B2 * | 1/2008 | Chang | 381/343 |
| 2003/0051940 | A1 | 3/2003 | Anthony et al. | |
| 2004/0086143 | A1 | 5/2004 | Espiritu | |
| 2004/0202342 | A1 | 10/2004 | Anthony et al. | |
| 2005/0069166 | A1 | 3/2005 | Peng | |
| 2005/0254682 | A1 | 11/2005 | Maekawa et al. | |
| 2006/0133637 | A1 | 6/2006 | Proni | |
| 2006/0285705 | A1 | 12/2006 | Kong | |
| 2007/0009133 | A1 | 1/2007 | Gerkinsmeyer | |
| 2007/0201718 | A1 | 8/2007 | Shimoe et al. | |
| 2008/0166010 | A1 | 7/2008 | Stiles et al. | |

FOREIGN PATENT DOCUMENTS

| | | | |
|---|---|---|---|
| EP | 0 122 990 | A1 | 10/1984 |
| EP | 0 341 926 | A1 | 11/1989 |
| EP | 0 551 845 | A1 | 7/1993 |
| EP | 0 622 971 | A1 | 11/1994 |
| EP | 0 624 049 | A2 | 11/1994 |
| EP | 0 749 265 | A1 | 12/1996 |
| EP | 1 515 584 | A1 | 3/2005 |
| EP | 1 755 357 | A2 | 2/2007 |
| EP | 1 976 331 | A1 | 10/2008 |
| FR | 1001734 | A | 2/1952 |
| FR | 2 565 058 | A1 | 11/1985 |
| FR | 2 667 212 | A1 | 3/1992 |
| FR | 2 892 887 | A1 | 5/2007 |
| GB | 652378 | | 4/1951 |
| GB | 701395 | | 12/1953 |
| GB | 2 250 658 | A | 6/1992 |
| GB | 2 404 520 | A | 2/2005 |
| JP | 55-010217 | A | 1/1980 |
| JP | 60-253399 | A | 12/1985 |
| WO | 95/28065 | A1 | 10/1995 |
| WO | 99/30533 | A1 | 6/1999 |
| WO | 02/054826 | A1 | 7/2002 |
| WO | 2007/122386 | A1 | 11/2007 |
| WO | 2007/122390 | A1 | 11/2007 |
| WO | 2008/008034 | A1 | 1/2008 |

OTHER PUBLICATIONS

French Preliminary Search Report for FR 1000155, dated Aug. 5, 2010.

International Search Report of PCT/FR2011/000023, dated Apr. 20, 2011.

French Preliminary Search Report for FR 1000154, dated Aug. 5, 2010.

French Preliminary Search Report for FR 1000156, dated Aug. 5, 2010.

French Preliminary Search Report for FR 1000157, dated Aug. 6, 2010.

International Search Report of PCT/FR2011/000023, dated Apr. 20, 2012.

* cited by examiner

COAXIAL SPEAKER SYSTEM HAVING A COMPRESSION CHAMBER WITH A HORN

The invention generally relates to the field of sound reproduction by means of loudspeakers, also named electro-dynamic or electro-acoustic transducers.

Sound reproduction consists of converting an electrical energy (or power) into acoustic energy (or power).

Electrical energy is most often provided by an amplifier the power characteristic of which may vary from several Watts for domestic audio installations of low power, to several hundred (or thousand) Watts for certain professional public address systems (recording studios, musical scenes, public areas, etc.).

Acoustic energy is radiated by a diaphragm the movements of which induce variations of pressure of the surrounding air, which propagate within space under the form of an acoustic wave.

Although it is somewhat recent, the technology of sound reproduction has given birth to a considerable number of different designs since the 1920's and the first trials conducted by Chester W. RICE and Edward W. KELLOG of GENERAL ELECTRIC, the names of whom, even today, disclose the most popular electro-acoustic transducer: the "Rice-Kellog" electro-dynamic loudspeaker.

In this kind of transducer, the diaphragm is displaced by a movable coil including a solenoid wire surrounded by a magnetic field and run by an electrical current (from the amplifier) . Interaction between the electrical current and the magnetic field induces a force known as "LAPLACE force", which induces a displacement of the movable coil, which in turn drives the diaphragm, the vibration of which provides acoustical radiation.

Although each human individual has his own audio characteristics, the human ear is considered sensitive to sounds on a frequency range (so-called audio range) comprised between 20 Hz and 20,000 Hz (20 kHz). The sounds below 20 Hz are called "infrasound"; those higher than 20 kHz are called "ultrasound". Infrasound and ultrasound are heard by certain animals but are considered as non perceivable by the human ear (one may refer to "Le livre des techniques du son, Tome 1, notions fundamentals, 3e edition, Chap. 4, La perception auditive, pp. 101, 192).

This is why, in loudspeaker building, one generally aims at reproducing the signals limited to the audio range. By convention, "low range" designates the range of frequencies comprised between 20 Hz and 200 Hz; "mid-range" designates the range of frequencies comprised between 200 Hz and 2,000 Hz (2 kHz); "high range" designates the range of frequencies comprised between 2,000 Hz and 20,000 Hz (20 kHz).

Numerous attempts have been made to design an electro-dynamic transducer permitting to reproduce in a satisfactory manner the whole audio range. Those attempts have failed.

Indeed, the reproduction of low range frequencies requires a transducer of great dimensions, and hence a diaphragm of important size, capable of important amplitude. On the contrary, the reproduction of high frequencies may only be satisfactory with a source of small size, and hence with a small diaphragm. Furthermore, the clearance of such small diaphragm is of low amplitude. As those characteristics are contradictory, one may easily understand that the construction of a unique transducer covering the whole audio range is truly difficult to achieve.

This is why an electro-dynamic transducer is generally designed to reproduce a narrow range of frequencies, within which the response of the transducer may be optimized.

The frequency acoustical response of such a transducer, measured by means of a microphone coupled to a spectrum analyzer, is usually represented under the form of a curve which illustrate the variations of acoustical pressure of the signal (expressed in dB, on a linear scale ordinarily comprised between 60 dB and 110 dB) in function of the signal frequency (expressed in Hz, ordinarily following a logarithmic scale comprised between 20 Hz and 20 kHz).

Although there are three families of transducers: low range, mid-range and high range, in practice however the classification is more precise, since the response of a transducer is a continuous function which may cross several ranges of frequencies. As an example, a transducer designed to reproduce the low range may offer a suitable response in the lower part of the mid-range (low medium); in a similar way, a high range transducer may offer a suitable response in the higher part of the mid-range (high medium), such that it is ordinary to designate by:

- low range transducer a transducer capable of reproducing the low frequencies and low medium;
- mid-range transducer a transducer capable of reproducing the medium frequencies and at least a higher part of the low frequencies and at least a lower part of the high frequencies;
- high range transducer a transducer capable of reproducing the high frequencies and at least the higher medium frequencies.

Apart from dimensional differences, the design of a transducer varies according to the type thereof: low, medium or high range. Accordingly, although there are numerous forms of diaphragms, the conical (or frusto-conical) shape is nowadays the most utilized in the low and mid-range transducers, whereas dome diaphragms are the most common in the high range transducers.

In order to reproduce the whole audio range, one therefore ordinarily combines several transducers to form a sound reproduction system. One common solution consists of combining three specialized transducer: one for the low range, one for the mid-range and one for the high range. However, mainly for economical reasons, it is ordinary to have only two transducers, i.e. a low range capable of reproducing low and low medium frequencies, and a high range capable of reproducing high medium and high frequencies. The transducers are generally mounted on a same loudspeaker enclose, most of the time on a same face (called front face of the enclosure). In loudspeaker terminology, the number of "ways" is equal to the number of segmentations formed on the audio range. Practically, the number of ways in a loudspeaker enclosure corresponds to the number of transducers it comprises. Accordingly, a loudspeaker enclosure comprising a low rage transducer and a high range transducer is a two-way loudspeaker enclosure.

Specialization of the transducer is however problematic, because of the electrical distribution, often called filtering. One may easily understand that, as each transducer is optimized only for one part of the spectrum, the signal must be filtered so that the transducer receives only one part of the signal it is capable of suitably reproduce. Bad filtering may have different consequences depending upon frequency. Without going into details, one may note that a high range signal directed to a low range transducer is simply not reproduced, whereas a low range signal directed to a high range transducer may easily destroy the transducer.

In a simplified manner, the filter of a two-way loudspeaker enclosure comprises a filtering section of the low-pass type, connected to the low range transducer of the system and which allows passage mainly of frequencies lower than a predetermined cut frequency, and a filtering section of the high-pass type, connected to the high range transducer of the system and which allows passage mainly of frequencies higher than the cut frequency.

The choice of filtering technology has no consequence on the design of transducers since filtering is provided upstream. However, sound reproduction by a multiple-way loudspeaker enclosure is problematic in a matter of spatial arrangement of the loudspeaker systems, because of the necessary recombination of individual sound signals from different ways. Such recombination is achieved in the air, and the slightest difference of path of the waves from different transducers generates time distortions and creates interferences which distort the recombination signal.

In order to avoid such distortions and interferences, numerous manufacturers try to mount different transducers of a compound system the closest to each other. Indeed, practice shows that two juxtaposed transducers which radiate in phase and the center-to-center distance of which is lower than a quarter of the wavelength behave almost as a unique acoustical source. Whereas such a dimension criterion seems acceptable a low frequencies (calculation provides a center-to-center distance of about 350 mm for a maximum frequency lower than 250 Hz, which is easily feasible), it may not be satisfied a high frequencies: as a example, at a frequency of 2 kHz, the distance between transducers should not be higher than 42.5 mm, which is not practically feasible (cf. Jacques Foret, Les enceintes acoustiques, in Le livre des techniques du son, Tome 2, La technology, 3e edition, chap. 3, p. 149).

This is why certain manufacturers have proposed systems the transducers of which are mounted coaxially, in order to make coincident the radiation axis, in order to lower distortions and interferences at the moment the audio signal recombines.

However, taken alone, the coaxial mounting of transducers does not solve the problem of mastering directivity. Indeed, the acoustic radiation of a transducer is not spatially homogeneous. At low frequencies (i.e. at great wavelengths), the diaphragm, of small dimension in comparison with the wavelength, may be regarded as a punctual source radiating an omnidirectional spherical wave. On the contrary, at high frequencies (i.e. at short wavelengths), the diaphragm, of great dimension in comparison with the wavelength, cannot be regarded as a sound source radiating in an omnidirectional manner, but tends to become directional.

As directivity of transducers varies in function to reproduced frequencies, the recombined signal coming out from such a compound loudspeaker system may comprise at the same time a signal component radiated in a directive manner from one of the transducers (e.g. from the low range transducer radiating in the upper part of its spectrum) and a signal component radiated in an omnidirectional manner from the other transducer (e.g. from the high range transducer radiating in the lower part of its spectrum).

One may easily understand that the recombined signal is not homogeneous in space, and that perception by the human ear may be therefore distorted. Indeed, as the acoustical signal coming out from the loudspeaker enclosure is not the same in every direction, different signals (both direct and reflected on the walls of the room) reaching the ears of the auditor shall not be coherent; such a coherence defect is detrimental to the quality of sound reproduction.

In addition, the directivity of every transducer increases with frequency. Sound professionals know that the audience of an auditorium located out of the axis of transducers does not perceive the high frequencies.

In order to remedy such difficulties, some manufacturers wish, not to make transducers omnidirectional whichever the frequency radiated (which appears impossible at the present stage of technology), by to control directivity of the transducers by maintaining somewhat constant the directivity on the whole radiated spectrum.

A well-known technique allowing for mastering directivity of a loudspeaker system consists of using a high range transducer with compression chamber and horn, mounted in a coaxial way behind a low range transducer (hereby called main transducer) equipped with a conical diaphragm.

This technique, known for a long time, has given birth to various architectures, such as the one proposed by Whiteley in 1952 (British patent GB 701,395), in which the horn of the high range transducer protrudes at the center of the cone of the low range transducer. Other solutions propose to use the cone of the low range transducer to form the horn of the high range transducer, cf. the architecture proposed by Tannoy in the 1940's and 1950's ("Dual concentric", "Twelve" models), enhanced until the end of the 1970's (U.S. Pat. No. 4,164,631, 1978 and U.S. Pat. No. 4,256,930, 1979). This technique allows for a good coherence of the acoustic field, with a conical directivity somewhat constant on the entire spectrum, which according to some authors may reach 90° (cf. L. Haidant, Guide pratique de la Sonorisation, ch. 6, pp. 64-67).

Using a horn and compression chamber transducer has other advantages. In this transducer, the diaphragm does not radiate directly in space, since radiation is forced to pass in a restricted space (so-called throat) having a section lower than that of the diaphragm—hence the expression "compression chamber".

The rate of a compression chamber transducer, providing an indirect radiation, is far higher than the rate of direct radiation transducers.

The rate of a transducer is defined as the division between the acoustical energy radiated in the whole space by the transducer, and the electrical energy absorbed (or consumed) by the transducer. Generally, the rate of direct radiation electro-dynamic transducers of ordinary design of the Rice-Kellog type is very low, of about several per thousands to several percents (generally not higher than 5%).

As the rate may not be measured directly, IEC 60268-5 standard recommends to measure the acoustical power of the source. Neglecting directivity of the transducer, its efficiency level, also called sensitiveness level, i.e. the sound pressure (in dB) generated by the transducer in half-space free field at a distance of 1 meter, for an consumed electrical poser of 1 W, allows for a good approximation of its rate. Such measure is achieved within the useful range of the transducer and along the axis, and may be regarded as the frequency response curve thereof.

Although many efforts are made nowadays on quality of sound reproduction (it is called fidelity), it seems that the best rate is not sought, since many manufacturers seem to think that a low energy rate may be compensated by the use of strong power amplifiers. It is true that low rate transducers may suffice to domestic installations, given the short spatial range needed (several meters at the maximum). However, for professional sound systems (e.g. for concerts in large arenas or outdoor), which require a long sound range, practice shows that it is preferable to use high rate transducers powered by a medium electrical power, instead of low rate transducers powered by a high electrical power. On the one hand, as most part of electrical power is dissipated under the form of heat by the magnetic circuit, high temperatures are witnessed in the second case, with temperatures reaching several hundreds of degrees which may corrupt the acoustic performance of the transducer and thereby request tricky cooling devices. On the other hand, compensating a weak rate by increasing the electrical power is limited by a phenomenon of limitation of the acoustical level, called thermal compression.

As already stated, horn and compression chamber transducers have far better rates than the ordinary direct radiation transducers. Those performances were witness very early, during the 1920's and the first developments of compression chambers. The sensitivity level of the famous WE 555 W model (manufactured by WESTERN ELECTRIC from 1928 for the equipment of entertainment arenas and first speaking movies), only partly disclosed in U.S. Pat. No. 1,707,545 in the name of its designer, Edward C. WENTE, reaches 118 dB/W/m (the measure was made on the original model with horn). In order to obtain such a level at the same frequency with a modern transducer considered having a rather good sensitivity in the field of high fidelity (88 dB/W/m), it would be necessary to drive it with an electrical power of 1,000 W (considering the logarithmic measure, a difference of 10 dB corresponds to a sensitivity factor of 10, therefore a difference of 30 dB corresponds to a factor 103=1,000).

One may therefore understand that, in addition to its interesting performances in matter of directivity and spatial coherence, the horn and compression chamber loudspeaker system is appreciated by professionals for its high rate. The invention aims at enhancing this kind of system. Indeed, despite its quality, such system has several drawbacks, among which:

- A time offset of the high range transducer with respect of the main transducer;
- The limits to the radiation angular opening (in other words the directivity), imposed by the dimensional architecture of the main transducer, and therefore by the directivity thereof;
- The spatial (mainly axial) volume and weight of the system;
- The difficulties to manufacture a powerful magnetic circuit for the main transducer, because of the necessity to form, in the center of the core of the magnetic circuit, a passage forming a horn initial section for the high range compression chamber transducer. Indeed, one may see, on several models, a lack of concentration of the magnetic field of the main transducer circuit (such a lack is due to the small passage of the magnetic field within the core, which is magnetically saturated.

In top quality professional sound systems, the delay of the high range way with respect of the low range way may be compensated by an active digital filtering (known as DSP, Digital Signal Processing). However, such compensation may only be partial, generally axial. In addition, conventional (and of lower cost) inductance and capacitor techniques of passive filtering cannot compensate the important delay (up to 250 μs) which is measured in known coaxial systems. Such a delay, although apparently low, has an important psychoacoustical effect and deteriorates the quality of sound restitution. It contributes to the "bad sound realism" or "bad sound quality" which sound engineers generally associate with professional public address.

The invention aims at contributing to resolve the aforementioned problems by providing enhancements to coaxial compression chamber loudspeakers.

The invention provides, in a first aspect, a coaxial two-way or more loudspeaker system comprising a main electro-dynamic transducer for the reproduction of low range and/or mid range frequencies, including:

- a main magnetic circuit defining a main air gap,
- a moving part comprising a diaphragm fixed to a movable coil diving into the main air gap;

wherein the system further comprises a secondary electrodynamic transducer for high range frequencies, mounted in a coaxial and frontal position with respect of the main electrodynamic transducer and including:

- a secondary magnetic circuit distinct from the main magnetic circuit and defining a secondary air gap,
- a moving part comprising a diaphragm fixed to a movable coil diving into the secondary air gap,
- a waveguide forming a whole horn, mounted in the vicinity of the diaphragm, and having a face facing and in the vicinity of the diaphragm and limiting a compression chamber, Such a system provides the following advantages, due to the coaxial frontal position of the high range with respect of the low range transducer:

- the time offset of the high range transducer with respect of the main transducer, which provides a better acoustical homogeneity;
- it is possible to push the limits of directivity of the traditional systems, characterized by the assembly of the horn through the center of the magnetic circuit of the low range transducer;
- the axial size of the system is equal to that of the low range transducer, and extra-weight of the system may be neglected;
- the passage section of the magnetic flow is less limited and it is possible to maximize the value and concentration of the magnetic field of the main transducer, since it is no longer necessary to have a hole in the magnetic circuit to form a passage for providing a horn initial section to the high range transducer.

The secondary transducer may be mounted onto a front face of a pole piece of the main magnet circuit. More precisely, the main magnet circuit includes e.g. a back pole piece including a central core having a front face on which the secondary transducer is mounted.

In one embodiment, the moving coil of the main transducer comprises a support and a solenoid winded onto the support, and the secondary transducer may be received within a space limited backwards by a front face of the pole piece of the main magnetic circuit, and laterally by the wall of the support of the movable coil, i.e. in coaxial and frontal position.

Assembly of the transducer is preferably such that the transducers have coincidence, or almost coincident acoustical centers.

In addition, the architecture of the secondary transducer may advantageously be of the endoskeleton type and have an inner chassis called endoskeleton on which the moving part of the secondary transducer is mounted through an inner suspension inside the diaphragm, whereby the moving part of the secondary transducer is free of outer suspension outside the diaphragm.

The secondary transducer may be fixed to the main transducer through its endoskeleton. In one embodiment, the endoskeleton comprises a plate fixed to the secondary magnet circuit, and a rod fixed to the plate and through which the secondary transducer is fixed to the main magnetic circuit.

In a second aspect, the invention provides a loudspeaker enclosure including a coaxial loudspeaker system as disclosed herein before.

The above and other objects and advantages of the invention will become apparent from the detailed description of preferred embodiments, considered in conjunction with the accompanying drawings in which.

Figure 1:
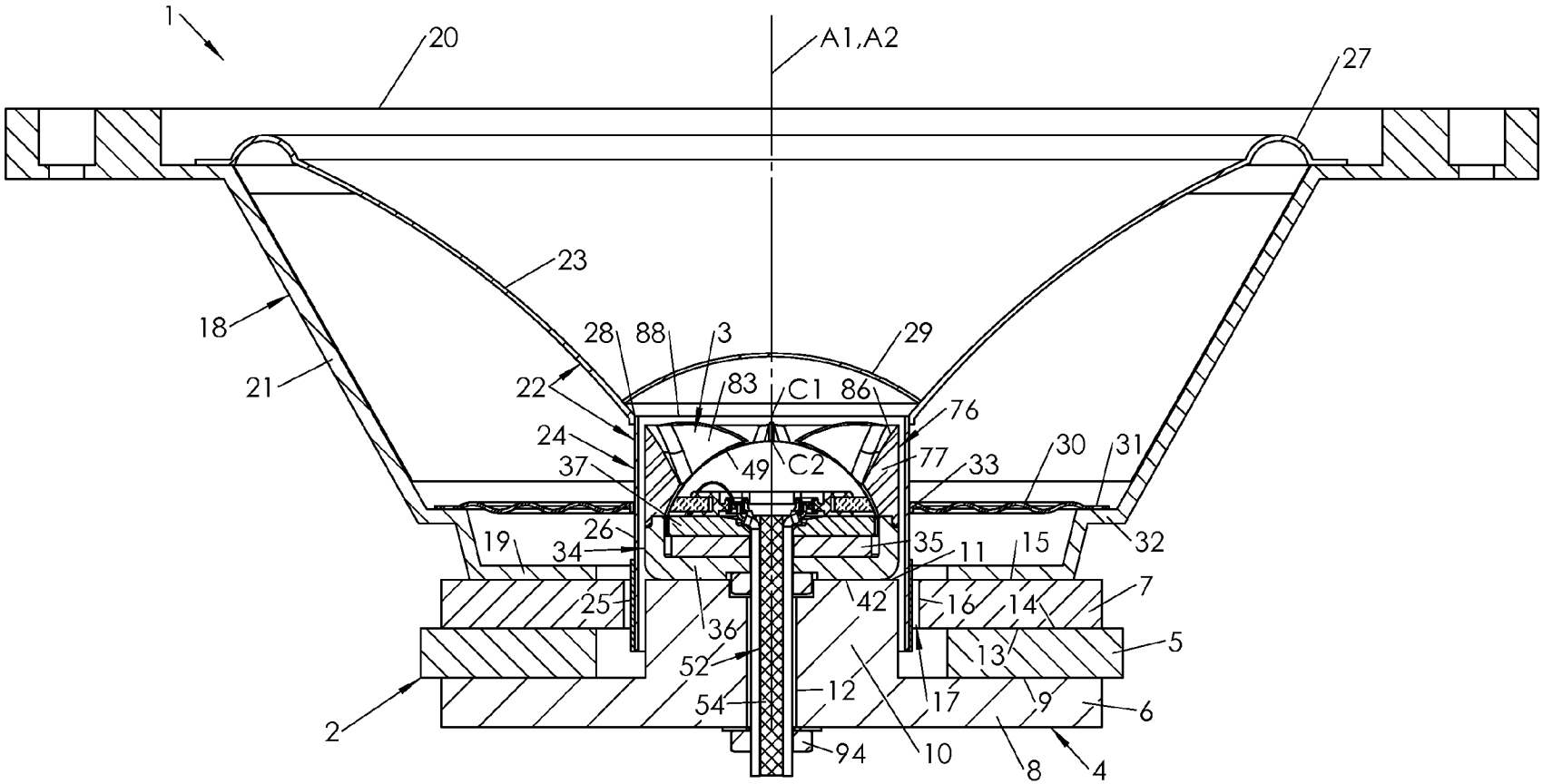
FIG. 1 is a sectional view showing a coaxial transducer system including a main low range transducer, and a high range compression chamber transducer.

In FIG. 1 is illustrated a coaxial several-way loudspeaker system 1. In the depicted example, the system comprises two was, but one may imagine a three-way ore more system.

System 1 is designed to cover an extended acoustical spectrum, ideally the whole audio range. It comprises a low range transducer 2, designed to reproduce a lower part of the spectrum, hereafter named "main transducer", and a high range transducer 3, designed to reproduce an upper part of the spectrum, hereafter named "secondary transducer".

Practically, the main transducer 2 may be designed to reproduce the low and/or the medium frequencies, and possibly part of the high frequencies. At this end, the diameter of the main transducer is preferably comprised between 10 and 38 cm. Although the main object of the present invention does not include the definition of parameters regarding the spectrum covered by the different transducers of the system 1, it shall be however noted that the spectrum of the main transducer may cover the lower range, i.e. the range of 20 Hz-200 Hz, or the mid-range, i.e. the rage of 200 Hz-200 Hz, or even at least part of the mid-range and low range (and for example the whole low range and mid-range) and possibly part of the high range. As an example, the main transducer 2 may be designed to cover a bandwidth of 20 Hz-1 kHz, or 20 Hz-2 kHz, or even 20 Hz-4 kHz.

The secondary transducer 3 is preferably designed so that its pass band is at lease complementary of the main transducer 2 in high range. One may therefore ensure that the pass band of the secondary transducer 3 covers at least part of the mid-range and the whole high range, up to 20 kHz.

It is preferable that the frequency bandwidths, where the response in amplitude of the transducers 2, 3 is of constant level, partly cross, and that the sensitivity level of the high range transducer be at least equal to that of the low range transducer, in order to avoid a decrease of the global response of the system 1 to certain frequencies corresponding to the higher part of the spectrum of the main transducer 2 and to the lower part of the spectrum of the secondary transducer 3.

As depicted on FIG. 1, the main transducer 2 comprises a main magnetic circuit 4 which includes an annular magnet 5, sandwiched between two soft steel pole pieces which form field plates, i.e. a back pole piece 6 and a front pole piece 7, glued on opposite face of the magnet 5.

The magnet 5 and the pole pieces 6, 7 have a rotational symmetry around a common axis A1 ("main axis") which forms the general axis of the main transducer 2.

In the depicted embodiment, the back pole piece 6 is of one piece and comprises an annular bottom 8 fixed to a back face 9 of the magnet 5, and a central cylindrical core 10, which has a front face 11 opposite the bottom 8 and is provided with a central bore 12 opening on both sides of the pole piece 6.

The pole piece or front plate 7 has the form of an annular washer and has a back face 13, by means of which it is fixed to a front face 14 of the magnet 5, and an opposite front face 15 which extends in the same plane as the front face 11 of the core 10.

The front plate 7 has at its center a bore 16 the inner diameter of which is greater than the external diameter of the core 10, so that between the bore 16 and the core 10 which is located therein is defined a main air-gap 17 in which part of the magnetic field generated by the magnet 5 is present.

The main transducer 2 includes a chassis 18 called basket, which includes a base 19 through which the basket 18 is fixed to the main magnetic circuit 4—and more precisely to the front face 15 of the front plate 7—, a crown 20 through which the transducer 2 is fixed to a holding structure, and a plurality of branches 21 linking the base 19 and the crown 20.

The main transducer 2 additionally comprises a movable part 22 including a diaphragm 23 and a movable coil 24 comprising a solenoid 25 coiled around a cylindrical support 26 fixed to the diaphragm 23.

The diaphragm is made of a light rigid material such as impregnated cellulose pulp, and has a conical or frusto-conical shape with rotational symmetry around the main axis A1, with a curved generatrix (such as a circular, exponential or hyperbolic law).

The diaphragm 23 is fixed on the surround of the crown 20 by means of a peripheral suspension 27 (also called rim) which may be made of an add-on tore piece glued to the diaphragm 23. The suspension 27 may be elastomeric (such as of natural or artificial rubber), polymeric (honeycombed or not) or in an impregnated and coated fabric or nonwoven.

In its center, the diaphragm 23 defines an opening 28 on the inner edge of which the support 26 is glued by a front end thereof. The geometrical center of the opening 28 is considered, in first approximation, as the acoustical center C1 of the main transducer 2, i.e. the equivalent punctual source from which the acoustical radiation of the main transducer is generated.

A hemispheric dust cap 29, made of an acoustically non emitting material, may be affixed to the diaphragm 23 in the vicinity of the opening 28 to protect the latter from dust.

The solenoid 25, made of a conductive metal wire (such as copper or aluminum), is rolled on the support 26, at a back end thereof located within the main air gap 17. Depending upon the diameter of the main transducer 2, the diameter of the solenoid 25 may be comprised between 25 mm and over 100 mm.

The centering, the elastic return force and the axial guiding of the movable piece 22 are achieved by the peripheral suspension 27 and by a central suspension 30, also called spider, of generally annular shape, with concentric corrugations, and having a peripheral edge 31 by which the spider 30 is glued to an edge 32 of the basket 18 in the vicinity of the base 19, and an inner edge 33 buy which the spider 30 is glued to the cylindrical support 26.

The solenoid 25 is provided with electrical signal in a classical way by means of two electrical conductors (not illustrated) connecting each end of the solenoid 25 to an electrical terminal of the transducer 2, where the link is made to a power amplifier.

As depicted on FIG. 1, the secondary transducer 3 is located within the main transducer 2 and is received within a central frontal space (i.e. on the front side of the magnetic circuit 4), limited backwards by the front face 11 of the core 10, and laterally by the inner wall of the support 26.

The secondary transducer 3 comprises a secondary magnetic circuit 34, separate from the main magnetic circuit 4, which includes a central annular permanent magnet 35, sandwiched between two pole pieces forming field plates, i.e. a back pole piece 36 and a front pole piece 37, glued onto two opposed faces of the magnet 35.

The magnet 35 and the pole pieces 36, 37 have rotational symmetry around a common axis A2 ""secondary axis") forming the general axis of the secondary transducer 3.

The magnet 35 is preferably made of a rare earth element neodymium iron boron alloy, which has the advantages of offering a high density of energy (up to twelve times higher than a permanent magnet of barium ferrite of same size).

Figure 2:
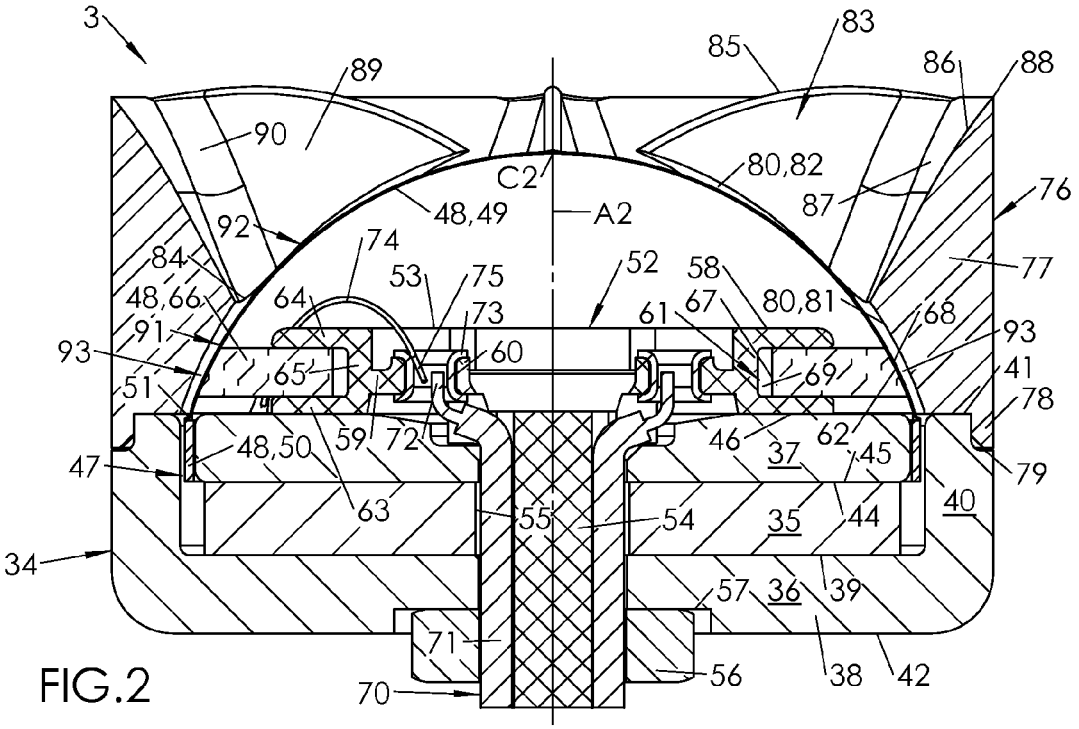
FIG. 2 is a sectional view of the high range transducer.

As depicted on FIG. 2, the back pole piece 36, called yoke, is of one piece and made of soft steel. It has a form of a cup with a U-shape diametrical section, and has a bottom 38 fixed to a back face 39 of the magnet 35, and a peripheral side wall 40 extending axially from the bottom 38. The side wall 40 ends, at a front end opposite to the bottom 38, by an annular front face 41. The bottom 38 has a back face 42 in contact with the front face 11 of the core 10, in a coaxial manner, i.e. such that the secondary axis A2 substantially merges with the main axis A1.

The front pole piece 37, called core, is also made of soft steel. It is of annular form and has a back face 44, by which it is fixed to a front face 45 of the magnet 35, and an opposite front face 46 which extends in the same plane as the front face 41 of the side wall 40 of the yoke 36.

As depicted on FIG. 2, the magnetic circuit 34 is extra-thin, i.e. its thickness is small with respect of its overall diameter. In addition, the magnetic circuit 34 extends up to the outer diameter of the transducer 3. In other words, the size of the magnetic circuit 34 is maximum with respect of the overall diameter of the transducer 3, which increases its power handling together with the value of the magnetic field, and hence the sensitivity of the transducer 3.

The core 37 has an overall diameter lower than the inner diameter of the side wall 40 of the yoke 36, so that between the core 37 and the side wall 40 is defined a secondary air gap 47 in which is concentrated most part of the magnetic field generated by the magnet 35.

In the air gap 47, the edges of the core 37 and of the yoke 36 may be chamfered, or preferably (and as depicted on FIG. 2), rounded so as to avoid harmful burrs.

The secondary transducer 3 also comprises a movable piece 48 including a dome shaped diaphragm 49 and a movable coil 50 fixed to the diaphragm 49.

The diaphragm 49 is made of a light and rigid material, such as a thermoplastic polymer or an aluminum-based alloy, magnesium or titanium. The diaphragm is such positioned as to cover the magnetic circuit 34 on the side of the core 37, and such that its axis of rotational symmetry be merged with the secondary axis A2. Hence, the apex of the diaphragm 49, located on the secondary axis A2, may be regarded as the acoustical center C2 thereof, i.e. the equivalent punctual source from which the secondary transducer 3 acoustically radiates.

The diaphragm 49 has a circular peripheral edge 51 which is slightly turned up, in order to facilitate the fixing of the movable coil 50.

The movable coil 50 comprises a conductive metal (e.g. copper or aluminum) wire solenoid (of circular or rectangular section), having a preferred width of 0.3 mm, spiral winded to form a cylinder, an upper end of which is glued to the turned-up peripheral edge 51 of the diaphragm 49. Here, the coil 50 has no support (but could have one).

The movable coil 50 dives in the secondary air gap 47. The inner diameter of the movable coil 50 is slightly higher than the external diameter of the core 37, so that the functional clearance formed between the movable coil 50 and the core 37 is low with respect of the width of the air gap 47. Alternately, the functional clearances may be dimensioned in a conventional manner.

In a preferred embodiment, at least the surrounding of the core 37 is coated with a thin layer of low friction polymer, such as PTFE, of a thickness of about 0.01 mm or less, and preferably several tens of μm (e.g. about 20 μm).

Accordingly, despite the low clearance between the core 37 and the movable coil 50, on the one hand, the mounting of the movable coil 50 within the air gap 47 is somewhat easy and, on the other hand, during use the axial movement of the movable coil 50 is not prevented by the nearby core 37, even in case both elements should accidentally and temporarily contact each other.

Practically, the movable coil 50 and the air gap are preferably such dimensioned that:

- The clearance between the movable coil 50 and the core 37 (including its coating) is less than a tenth of a millimeter, and for example comprised between 0.05 mm and 0.1 mm. In a preferred embodiment, the inner clearance is of 0.08 mm (it might be possible to dimension this clearance in a classical manner);
- The outer clearance formed between the movable coil 50 and the side wall 40 of the yoke 36 be less than 0.2 mm, and for example comprised between 0.1 mm and 0.2 mm. In a preferred embodiment, the outer clearance is of 0.17 mm.

Accordingly, the maximum width of the air gap 47, for a movable coil 50 having a width of 0.3 mm, is of 0.6 mm (with an inner clearance of 0.1 mm and an outer clearance of 0.2 mm). In such configuration, the rate of occupation of the movable coil 50 in the air gap 47, equal to the ratio between the sections of the movable coil 50 and the air gap 47, is about 50%. In a preferred configuration, for an air gap width of 0.55 mm, an inner clearance of 0.008 mm and an outer clearance of 0.17 mm, the occupation rate of the movable coil 50 within the air gap 47 is of about 55%.

Those values shall be compared to the ordinary known occupation rate values, which are lower than about 35%.

The reduced width of the air gap 47 induces an increase of the density of magnetic flow within the air gap 47, and a subsequently increased of the level of sensitivity of the transducer 3, whereby sensitivity varies as the square of the density of the magnetic flow within the air gap 47.

It is advantageous to fill the air gap 47 with a mineral oil loaded with magnetic particles, such as of the type sold by FERROTEC under trade name Ferrofluid™. Such a filling has the following advantages:

- It contributes to the centering of the movable coil 50 within the air gap 47;
- It functions as a dynamic lubricant, and therefore contributes to the silent operation of the transducer 3;
- Its thermal conductivity, which is far higher than the thermal conductivity of air, contributes to the evacuation, toward the magnetic circuit 34 (and more specifically toward the yoke 36), of the heat produced by Joule effect within the movable coil 50.

The secondary transducer 3 further comprises a support 52 fixed to the magnetic circuit 34 and to which the moving piece 48 is suspended. The support 52, which is made of a diamagnetic and electrically insulating material, for example a thermoplastic material such as polyamide or polyoxymethylene (charged with glass or not), has a general shape of rotational symmetry around an axis merged with the secondary axis A2, and has a T-shaped section.

The one-piece support 52 forms an endoskeleton for the transducer 3, including an annular plate 53 contacting the front face 46 of the core 37, and a cylindrical rod 54 which protrudes backwards from the center of the plate 53, and which is located in a complementary cylindrical recess 55 formed within the magnetic circuit 34 and formed by a succession of coaxial drillings made in the yoke 36, the magnet 35 and the core 37.

As depicted on FIG. 2, the endoskeleton 52 is rigidly fixed to the magnetic circuit 34 by means of a nut 56 screwed onto a threaded section of the rod 54 and tightened against the yoke 36, within a counterbore 57 formed in the back face 42, at its center. Thereby, the plate 53 is tightly urged against the front face 46 of the core 37, without rotational possibility. This fixing may be completed by a glue film between the plate 53 and the core 37.

Given its frontal situation with respect of the magnetic circuit 34, the plate 53 extends within the lenticular inner volume limited by the diaphragm 49. The plate 53 comprises a peripheral annular rim 58 and a central disc 59 to which the rod 54 connects. The disc may be drilled with holes 60 for maximizing the volume of air under the diaphragm 49, in order to lower the resonance frequency of the moving piece 48.

The rim 58 has substantially the shape of a pulley and comprises a peripheral annular groove 61 which radially opens inwards, facing an annular peripheral portion 62 of the inner surface of the diaphragm 49, located in the vicinity of the edge 51.

The groove 61 separates the rim 58 in two flanges facing each other, which form the side walls of the groove 61, namely a back flange 63, which contacts the front face 46 of the core 37, and a front flange 64. Both flanges 63, 64 are connected through a cylindrical web 65 forming the bottom of the groove 61.

The moving piece 48 is mounted onto the endoskeleton 52 by means of an inner suspension 66 which connects the diaphragm 49 and the plate 53. This suspension 66 has a rotational symmetry and is made of a light, elastic, acoustically non emissive material (the material may be porous). This material is preferably resistant to heat within the transducer, and its elasticity is chosen so that the resonance frequency of the moving piece 48 be lower than the lowest frequency reproduced by the transducer 3 (i.e. 500 Hz to 2 kHz).

In the absence of acoustical emissivity of the suspension 66, only the dome diaphragm 49 emits an acoustical radiation, whereby fundamental modes, resonances, and more generally parasite acoustical radiation of suspension 66, which would interfere with radiation of the diaphragm 49 and would therefore decrease the performance of the transducer, are avoided.

Figure 4:
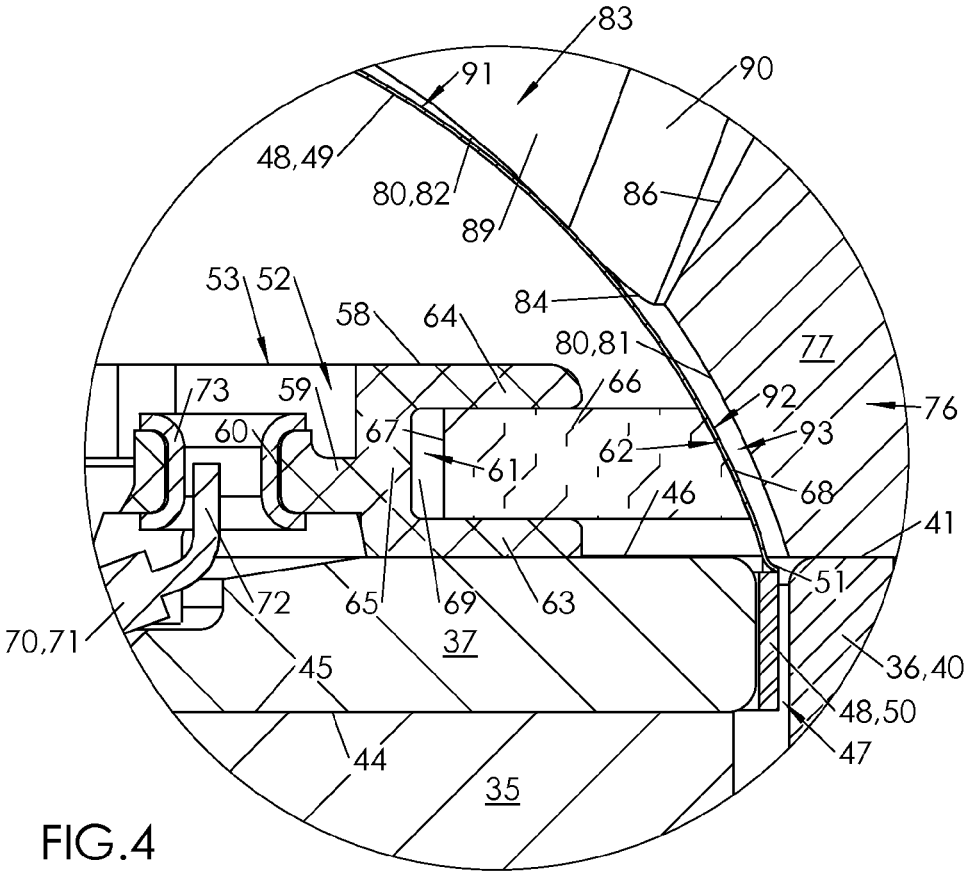
FIG. 4 shows a detail of FIG. 2.
Figure 5:
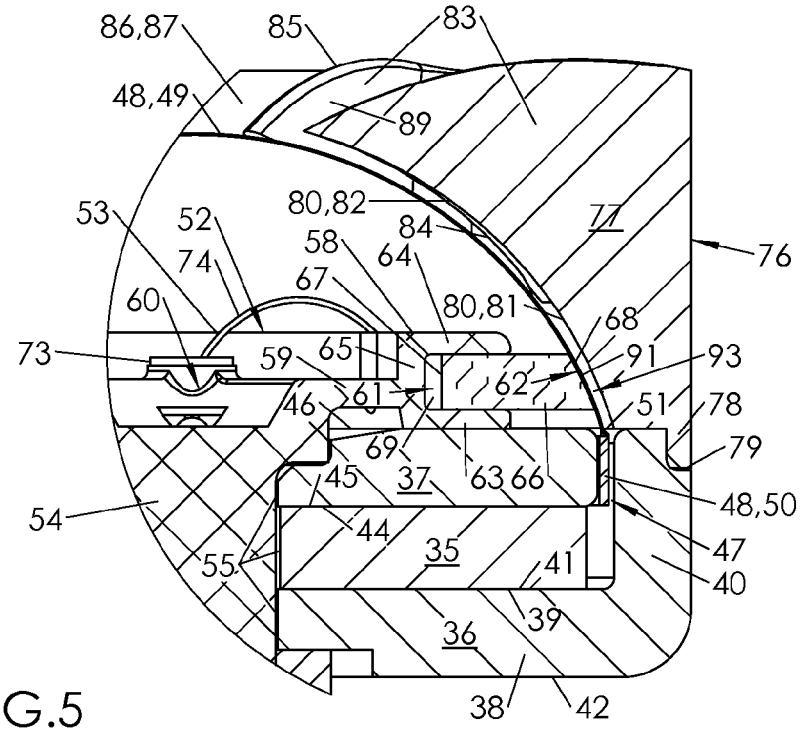
FIG. 5 is a sectional view showing a detail of the high range transducer.

In a preferred embodiment, called "floating assembly", illustrated on FIG. 2, FIG. 4 and FIG. 5, suspension 66 has a section in a substantially polygonal shape and comprises a straight inner edge 67, i.e. with rotational symmetry around the secondary axis A2, and a peripheral outer edge 68 of substantially frusto-conical shape.

The suspension 66 may be made in a fabric of natural fibers (such as cotton) or synthetic fibers (such as polyester, polyacrylic, Nylon™, and more specifically aramides such as Kevlar™), or in a mixture of natural and synthetic fibers (such as cotton-polyester), wherein the fibers are impregnated with a thermosetting or thermoplastic resin, which gives strength, stiffness and elasticity to the suspension 66. However, the suspension 66 shall preferably be made of a reticulated polymer foam (such as of polyester or melamine), which is highly suitable because of its high porosity.

The suspension 66 is glued through its outer frusto-conical edge 68 to the peripheral portion 62 of the inner surface of the diaphragm 49. Alternately, in case the movable coil 50 includes a cylindrical support fixed to the diaphragm 49 and on which the solenoid is mounted, the suspension 66 may be fixed, through its outer peripheral edge (which would then be cylindrical) onto the outer surface of this support.

As depicted in FIG. 2, the thickness of suspension 66 (measured along the secondary axis A2), although lower than its free length (measured radially between the flanges 63, 64 and the inner surface 62 of the diaphragm 49), is not immaterial but of the same order of size than this length. More precisely, the ratio between the free length and the thickness of the suspension 66 is preferably lower than 5 (and here lower than 3). Minimizing the free length of the suspension 66 allows for stabilizing the moving piece 48 and prevents tilting thereof (anti-pitch effect).

On the side of its inner edge 67, the suspension 66 is located within the groove 61 with a slight compression between the flanges 63, 64 in order to avoid parasite noises, but without being fixed thereto. In addition, the inner diameter of the suspension is higher than the inner diameter of the groove 61 (i.e. to the outer diameter of the web 65 of the rim), such that an annular space 69 is formed between the suspension 66 and the web 65.

Accordingly, the suspension 66 is floating with respect of the rim 58 of the plate 53, with a possible radial clearance, whereby the suspension 66 may slip with respect of the flanges 63, 64. In order to contribute to this slipping, a layer of pasty lubricant (such as grease) may be applied onto the flanges 63, 64. The radial clearance defined by the annular space 69 between the suspension 66 and the web 65 (i.e. the bottom of the groove 61) is preferably less than 1 mm. In a preferred embodiment, the clearance is of about 0.5 mm. In the drawings, this clearance is exaggerated for the sake of clarity.

In an alternate "non floating" assembly, the suspension 66 may be glued inside the flanges 63, 64 instead of simply being greased. In this case, the dimensions of radial clearances are of the conventional type and not reduced as in the floating assembly disclosed hereinbefore. In a non floating assembly, the moving piece 48 shall be centered with respect of the air gap by means of a centering tool (named false yoke), in the manner disclosed hereinafter in reference to the alternate spider suspension 66 shown on FIG. 6.

In addition, it is preferable that the part of suspension 66 located within the groove 61 have a width (measured radially) higher or equal to its thickness, in order to ensure good mechanical link of the planar contact type and minimize any harmful tilting of the suspension 66 with respect of the plate 53.

The suspension 66 thereby extends inside the diaphragm 49. The suppression of an external peripheral suspension allows for avoiding acoustical interferences which exist in known transducers, between the radiation of the diaphragm and the radiation of its suspension.

In addition, as the suspension 66 exerts no radial constraint on the diaphragm 49, it does not provide any centering function of the diaphragm with respect of the secondary magnetic circuit 34, thereby improving the simplicity of assembly of the secondary transducer 3, or of replacement of the diaphragm 49 in case of failure.

The centering of the diaphragm 49 is achieved at the level of the movable coil 50, which is adjusted with a small clearance onto the core 37 and automatically centers with respect thereof as soon as the movable coil 50, dived into the magnetic field of the air gap 47, is displaced by a modulation electric current.

However, the suspension 66 provides a return force onto the moving piece 48 toward a rest position, in the absence of axial constraint exerted on the movable coil 50 (i.e., practically, in the absence of current through the coil). It is in this intermediate position that the transducer 3 is illustrated in the appended drawings.

The suspension 66 also provides a function of maintaining the trim of the diaphragm 49, i.e. of maintaining the peripheral edge 51 of the diaphragm 49 in a plane perpendicular to the secondary axis A2, in order to avoid tilting (or pitch) of the diaphragm 49 which would affect its good operation.

Figure 6:
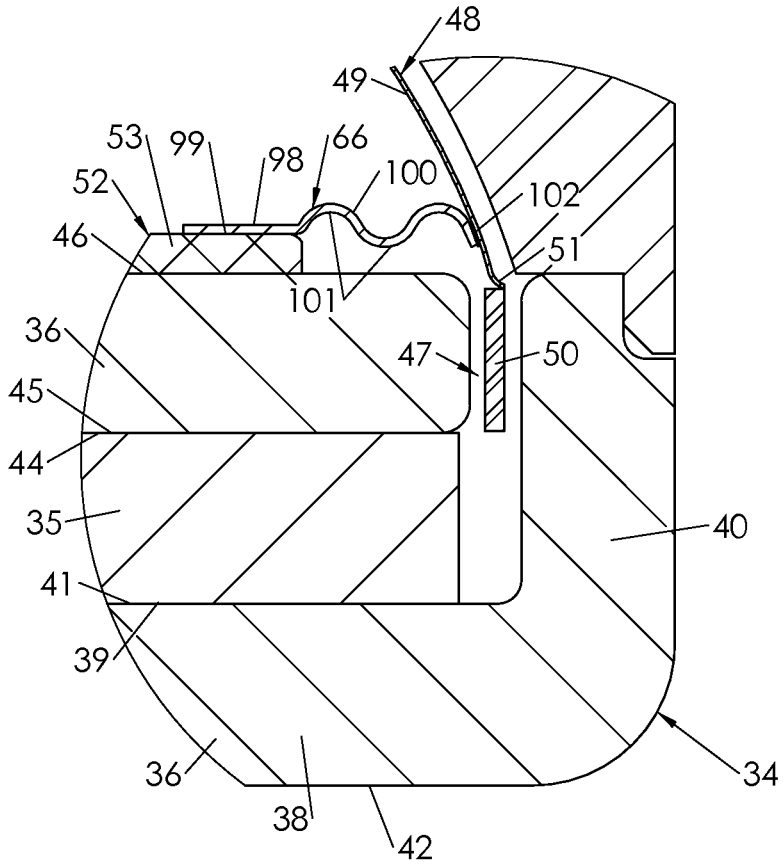
FIG. 6 is a view similar to FIG. 5, showing an alternate embodiment of the high range transducer.

In FIG. 6 is depicted an alternate "non floating" embodiment of the secondary transducer 3, which differs from the hereabove disclosed preferred embodiment through the design of the suspension 66 and the form of the endoskeleton 52.

The suspension 66 is indeed of the spider type and made in a fabric of natural fibers (such as cotton) or synthetic fibers (such as polyester, polyacrylic, Nylon™, and more specifically aramides such as Kevlar™), or in a mixture of natural and synthetic fibers (such as cotton-polyester), wherein the fibers are impregnated with a thermosetting or thermoplastic resin, which gives strength, stiffness and elasticity to the suspension 66.

The suspension includes an inner annular, planar portion 98, glued to an upper face 99 of the plate 53, and a peripheral section 100 which extends around the inner portion 98. The peripheral portion 100 freely extends radially outside from the plate 53 and comprises corrugations 101 which may be thermoformed.

The suspension 66 has an outer edge 102 through which it is glued to the inner surface of the diaphragm 49, in the vicinity of the peripheral edge 51 thereof. Alternately, in case the movable coil 50 includes a cylindrical support fixed to the diaphragm 49 and onto which the solenoid is mounted, the suspension 66 may be fixed, through its outer edge, onto the inner surface of such support.

One may note that the moving piece 48 should be perfectly centered with respect of the magnetic circuit 34, and more precisely with respect of the air gap 47 in which the movable coil 50 is located. To this end, a centering assembling tool (false yoke) is used, in which the endoskeleton is positioned. The centering assembling tool comprises a bore (the diameter of which is equal to the diameter of the recess 55) in which the rod 54 of the endoskeleton 52 is inserted. The suspension 66 is then glued onto the plate 53. Before the glue has become sticky, the inner diameter of the moving coil 50 is centered with respect of the bore of the mounting assembly, which ensures the centering of the moving part 48 with respect of the endoskeleton 52. After the glue becomes sticky, the assembly comprising the moving piece 48 and the endoskeleton 52 may then be mounted in a perfectly centered way within the magnetic circuit, either in a manufacturing or a repair process of the moving piece 48.

The electric current is provided to the movable coil 50 by two electrical circuits 70 which link the ends of the movable coil 50 to two feeding electrical terminals (not illustrated).

As depicted in FIG. 2, each electrical circuit 70 comprises:

An electrical conductor 71 of great diameter, including a copper wire insulated with a plastic jacket, extending through the magnetic circuit 34 and located within a slot formed longitudinally within the rod 54 of the endoskeleton 52, and a stripped front end 72 of which opens in the inner volume of the diaphragm 49 and protrudes from the magnetic circuit 34 at the level of a hole 60;

An electrical connection element under the form of a metal eye 73 (made of copper or brass) crimped within the hole 60 and to which the stripped end 72 of the conductor 71 is electrically linked (for example by means of a welding point, not illustrated);

A conductor 74 of small diameter, under the form of a resilient metallic braid suitably formed, which extends within the internal volume of the diaphragm 49 and extending over the rim 58 and the suspension 66, in the preferred floating assembly embodiment, and an inner end 75 of which is electrically connected to the eye 73 (for example by means of a welding point, not illustrated), and an opposite outer end of which is electrically connected to an end of the movable coil 50.

Only one conductor 74 of small diameter is visible on FIG. 2. the second one, which is diametrically opposite to the latter, is located in front of the section plane of the figure.

Due to their arcuate form (U-shape of the conductors 74, and to their great resilience, the conductors may deform easily and follow the movements of the diaphragm 49 which accompany the vibrations of the movable coil 50, without adding any radial or axial constraint which might compromise the free positioning of the moving piece 48.

The secondary transducer 3 comprises an acoustical waveguide 76, fixed to the magnetic circuit 34.

The waveguide 76 is one piece and is made of a material having a high thermal conductivity, higher than $50\ W \cdot m^{-1} \cdot K^{-1}$, such as in aluminum (or an aluminum alloy).

The waveguide 76 has a rotational symmetry, is fixed to the yoke 36 and comprises a substantially cylindrical outer side wall 77 which extends flush with the side wall 40 of the yoke 36. The waveguide is preferably screwed, by means of at least three screws. In order to maximize thermal contact between both pieces, it is advantageous to complete the screwing by applying a heat conducting paste.

As depicted on FIG. 2 and FIG. 5, the waveguide 76 has, on a back peripheral edge, a skirt 78 which adjusts on a shoulder 79 made in the yoke 36, of complementary shape, whereby a precise centering of the waveguide with respect of the yoke 36, and more generally with respect of the magnetic circuit 34 and the diaphragm 49, is provided. In addition, thermal conduction between both pieces 36, 76 is enhanced.

The waveguide 76 has a back face 80 shaped like a substantially spherical cap, which extends in a concentric way with respect of the diaphragm 49, facing and in the vicinity of an outer face thereof, which the back face 80 partly covers.

In a preferred embodiment depicted in FIG. 1-5, the back face 80 is provided with openings and comprises a continuous peripheral portion 81 which extends in the vicinity of the back edge of the waveguide 76, and a discontinuous central portion 82 carried by a series of wings 83 which radially protrude inwardly (i.e. towards the axis A2 of the transducer 3) from the side wall 77. The back face 80 is limited inwardly—i.e. on the diaphragm side—by a petaloid shaped edge 84.

Figure 3:
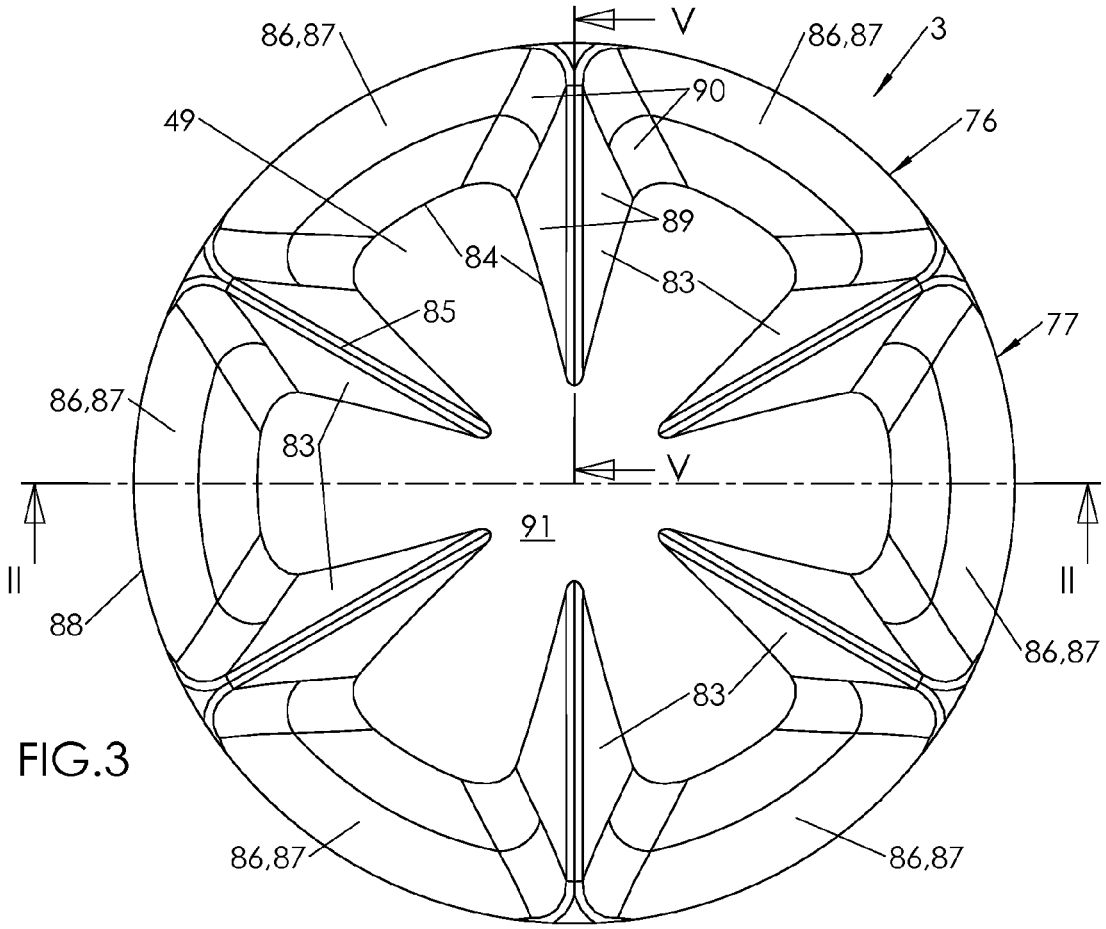
FIG. 3 is a top view of the high range transducer.

As depicted on FIG. 3, the wings 83 do not meet at the axis A2 but are interrupted at an inner end located at a distance from axis A2. At its apex, each wing has a curved edge 85.

The side wall 77 of the waveguide 76 is limited inwardly by a discontinuous frusto-conical front face 86 divided into a plurality of angular sectors 87 which extend between the wings 83. This front face 86 forms a horn initial section extending from the inside to the outside and from a back edge, formed by the petaloid edge 84 which forms a throat of the horn initial section 86 up to a front edge 88 which forms a mouth of the horn initial section. The angular sectors 87 of the horn initial section 86 are portions of a cone with rotational symmetry the axis of which is merged with the secondary axis A2, and the generatrix of which is curved (for example following a circular, exponential or hyperbolic law). The horn initial section 86 ensures a continuous acoustical impedance adjustment between the air environment limited by the throat 84 and the air environment limited by the mouth 88.

In an embodiment, the tangent to the horn initial section 86 on the mouth 88 forms, together with a plane perpendicular to the axis A2 of the secondary transducer 3, an angle comprised between 30° and 70°. In the depicted example, this angle is of about 50°.

Each wings 83, the function of which shall be disclosed hereinafter, has two side flanges 89 which outwardly connect to the angular sectors 87 of the horn initial section 86 through fillets 90.

Figure 7:
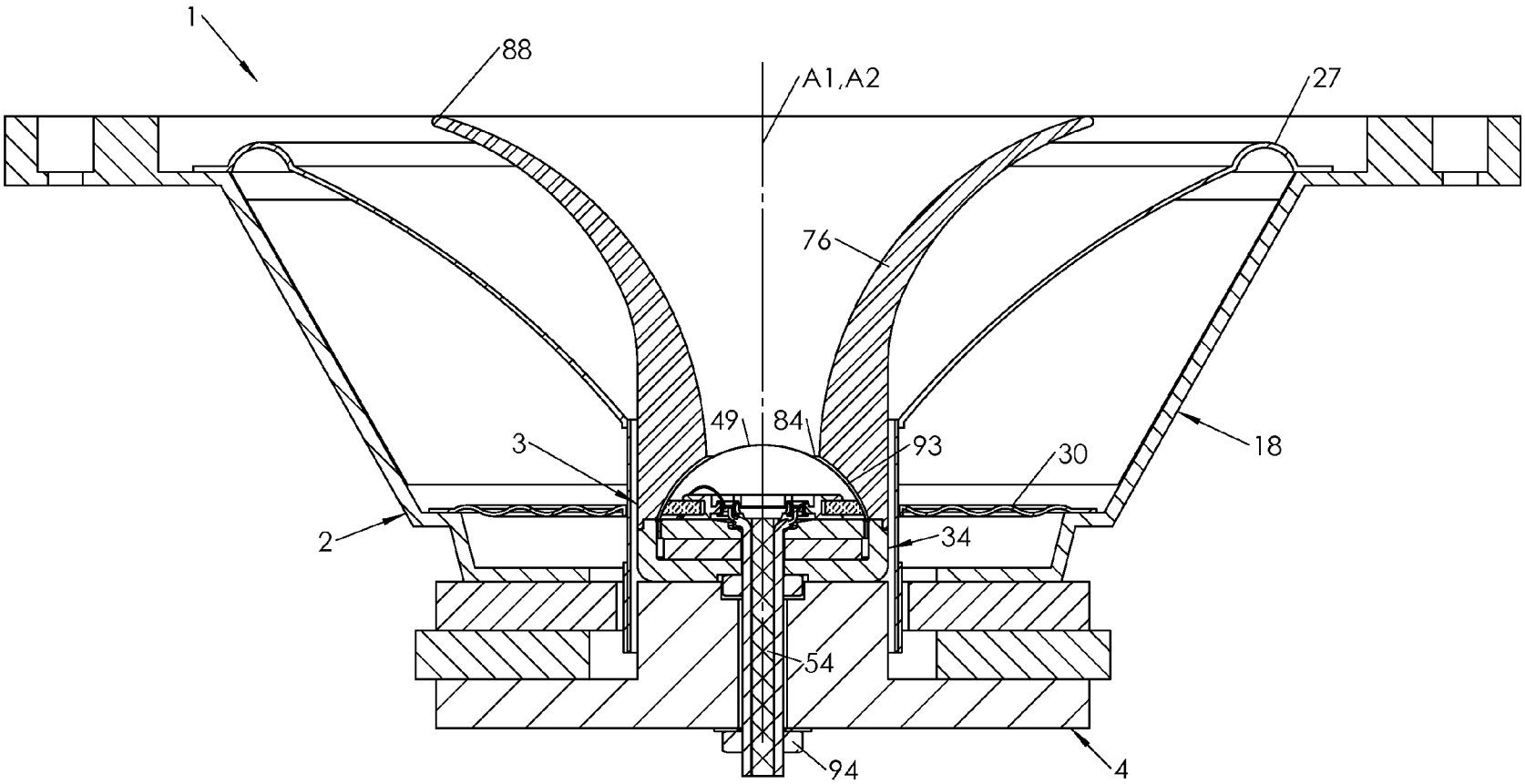
FIG. 7 is a perspective view showing an alternate embodiment of a waveguide for a transducer as illustrated on FIG. 2-5.
Figure 8:
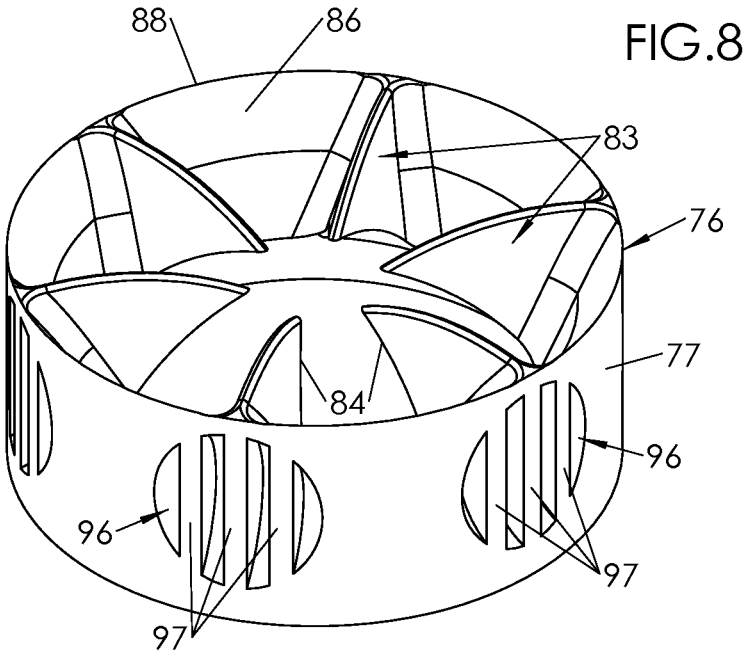
FIG. 8 is a view similar to FIG. 1, showing an alternate embodiment.

In an alternate embodiment depicted on FIG. 7, the waveguide 76 does not form a horn initial section but a whole horn (which may be of rotational symmetry around the secondary axis A2), the throat 84 of which is of circular shape and the length of which is such that, when the secondary transducer 3 is mounted within the main transducer 2, the mouth 88 may extend, as in FIG. 8, further to the peripheral suspension 27 of the diaphragm 23.

The waveguide 76 limits on the diaphragm 49 two distinct and complementary zones, namely:

An uncovered outer zone 91, of petaloid shape, outwardly limited by the throat 84, A covered outer zone 92, the shape of which is complementary to the covered zone 91, inwardly limited by the throat 84.

The back face 80 of the waveguide 76 and the corresponding covered outer zone 92 of the diaphragm 49 together define an air volume 93 called compression chamber, in which the acoustical radiation of the vibrating diaphragm 49 driven by the coil 50 moving in the air gap 47 is not free, but compressed. The uncovered inner zone 91 directly connects to the facing throat 84, which concentrates acoustical radiation of the whole diaphragm 49.

The compression rate of the transducer 3 is defined by the ratio of its emitting surface, corresponding to the planar surface limited by the overall diameter of the diaphragm 49 (measured on the edge 51) and the surface limited by the projection, in a plane perpendicular to the axis A2, of the throat 84. This compression rate is preferably higher than 1.2:1, and for example of about 1.4:1. Higher compression rates, for example up to 4:1, are possible.

As depicted on FIG. 1, the secondary transducer is mounted within the main transducer 2 both:

In a coaxial way, i.e. the main axis A1 and the secondary axis A2 are merged, In a frontal way, i.e. the secondary transducer is positioned in the front of the main magnetic circuit 4 (i.e. on the side of the magnetic circuit where the diaphragm 23 is located).

Practically, the secondary transducer 3 is fixed to the main magnetic circuit 4 on the front side thereof and is received, as already stated, in a space limited backwards by the front face 11 of the core 10, and sidewise by the inner wall of the cylindrical support 26; the yoke 36 of the secondary magnetic circuit 34 is urged directly, or through a spacer, against the front face 11 of the core 10. To this end, the secondary transducer 3 has an overall diameter lower than the inner diameter of the cylindrical support 26. However, it is preferable to minimize the clearance between the secondary transducer 3 and the support 26, in order to reduce the harmful acoustical effect produced by the annular cavity formed between them. This clearance should however be sufficient to prevent friction of the support 26 onto the secondary transducer 3. A low clearance, of several tenths of millimeters (comprised e.g. between 0.2 mm and 0.6 mm) is a good compromise (on FIG. 1 and FIG. 7 such clearance is exaggerated for the sake of clarity).

The rod 54 of endoskeleton 52 is received within the bore 12 of the core 10, and the secondary transducer 3 is rigidly fixed to the magnetic circuit 4 of the main transducer 2 by means of a nut 94 screwed onto a threaded portion of the rod 54 and tightened against the yoke 6, possibly with a washer therebetween, as depicted on FIG. 1.

This so-called "frontal" assembly, which is opposite to the rear assembly in which the transducer is mounted on the back face of the yoke (cf. e.g. U.S. Pat. No. 4,164,631 to Tannoy) is made possible due to the peculiar architecture of the high range transducer 3, which is of the "endoskeleton" type.

Firstly, the situation of the suspension 66 inside the dome diaphragm 49 and the manufacturing of the suspension 66 in an acoustically non-emitting material suppresses acoustical interferences between suspension 66 and diaphragm 49.

Secondly, the fact that suspension 66 extends inside the diaphragm 49 instead of outside of it allows for increasing the emitting surface up to 100% of the overall diameter of the diaphragm 49.

This increase of the emitting surface of the diaphragm 49 allows for a substantial gain in terms of sensitivity of the transducer 3, since this gain is proportional to the square of the emitting surface. Practically, the architecture of the transducer 3 allows, considering the overall diameter of the transducer equal, for an increase of the emitting surface up to 17%. Therefore, the gain in sensitivity is of about 1.4 dB.

Thirdly, due to the absence of suspension outside the diaphragm 49, the diameter of the movable coil 50 may be increased, up to being equal to the diameter of the diaphragm 49. As a result, the admissible power of the movable coil 50 is increased in proportion with the increase of its diameter. More precisely, a 20% increase of the diameter of the movable coil induces an equivalent gain in power handling.

Fourthly, as the moving piece 48 is fixed inside the diaphragm 49, through the suspension 66 and the endoskeleton 52, the transducer 3 is free of a radially cumbersome external support. Due to the 100% emitting diaphragm 49, the ratio between the emitting surface and overall radial size (which is equal to the ratio of the squares of the radiuses of the diaphragm and transducer) is increased, up to about 70%.

Such ratio allows for making a short horn initial section 86 (measured axially), which permits the mounting of the transducer in an axial and frontal position within the low range transducer, with a tangential continuity between the horn initial section 86 and the diaphragm 23 of the low range transducer 2.

In addition, the absence of exoskeleton prevents thermal confinement of the magnetic circuit 34. This aspect, combined with the direct thermal contact between the yoke 36 and the waveguide 76, which is made of a good heat conducting material, allows for significant increase of the heat dissipating capacity of the transducer 3, and hence of its power handling.

As already explained, the transducer 3 is free of an external cumbersome support outside the diaphragm 49, since such support is achieved through the endoskeleton 52. This aspect, combined with the increased diameter of the movable coil 50, equal to the diameter of the diaphragm 49, allows for an increase of the diameter of the magnetic circuit 34, up to the overall diameter of the transducer 3, as depicted on FIG. 2 and FIG. 6.

This induces an increase of the BL product (i.e. the product of the magnetic field within the air gap 47 and the wire length of the solenoid 50, which is proportional to the Laplace force displacing the moving piece 48), and hence a gain in transducer sensitivity (proportional to the square of the BL product increase). Practically, due to the endoskeleton type architecture of the transducer 3, an increase of the BL product by about 40% may be obtained, and hence a sensitivity gain up to about 3 dB.

In addition to the coaxial frontal positioning of the secondary transducer 3 with respect of the main transducer 2, their respective geometries, the thickness of the magnetic circuits 4, 34 and the curvature (and hence the depth) of the diaphragm 23, are preferably adapted to permit at least an approximate coincidence of the acoustic centers C1, C2 of the transducers 2, 3, such that the time offset between the acoustical radiation of the transducer 2, 3 be unperceivable (this situation is called time alignment of the transducers 2, 3). The system 1 may then be regarded as perfectly coherent despite duality of the sound sources.

One may reasonably consider that a time offset δ lower than about 25 μs is quite unperceivable. Practically, such a time offset corresponds, along axis A1, by a physical offset d between the acoustic centers C1, C2 lower than about 10 mm, according to the following conversion equation:

$$d=\delta Cair$$

where Cair is the speed of sound within the air.

The good coherence of the system 1 makes it unnecessary to compensate the time offset, which may not be corrected in passive filtering and the active filtering of which may induce time coherence defects outside the acoustic axis.

In addition, in the main embodiment, the axial positioning of the secondary transducer 3 with respect of the main transducer 2, together with the geometry of the waveguide 76, are such that the diaphragm 23 is aligned with the horn initial section 86, as depicted on FIG. 1. In other words, the tangent to the horn initial section 86 merges with the tangent to the diaphragm 23 at its central opening 28. In such a configuration, the waveguide 76 and the diaphragm 23 of the main transducer together form a complete horn for the secondary transducer 3, permitting both transducers 2, 3 to have homogeneous directivities.

In the alternate embodiment of FIG. 7, the waveguide 76 forming a whole horn is independent from the diaphragm 23 of the main transducer 2. In such configuration, the directivities of the transducers 2, 3 are distinct and may be optimized separately, which is advantageous in some applications, such as scene monitor speakers.

In addition to the acoustic impedance adaptation of the secondary transducer 3 between the throat 84 and the mouth 88, the waveguide 76 provides, through the wings 83, a dissipation function of heat produced by the magnetic circuit 34.

In an optional embodiment depicted on FIG. 8, the waveguide 76 acting as a radiator may comprises, in cavities 96 formed in the outer edge of the side wall 77, facing each wing 83, complementary protrusions 97 formed by radial outer fins which radially extend up to (but not further) the overall diameter of the transducer 3.

Such fins 97 efficiently provide a contribution to the cooling of the transducer 3 due to their position within the annular space between the transducer 3 and the inner face of the support 26 of the movable coil 24 of the main transducer 2, within which space circulates a pulsed air flow produced by the movements of the moving part 22 of the transducer 1.

In the coaxial frontal architecture disclosed hereabove, part of the heat inwardly radiated by the solenoid 25 is evacuated backwards the magnetic circuit 4, but part of the heat is also provided to the secondary transducer 3. Such heat induces an exogenous heating of the secondary transducer, which adds to its endogenous heating produced by Joule effect by its own movable coil 50. Although the endogenous heating of the secondary transducer 3 is less important than the heating of the main transducer 2, it is however necessary to dissipate the heat produced by the secondary transducer 3. That is the secondary function of the waveguide 76, due:

- firstly, to its high thermal conductivity material (i.e. the thermal conductivity is higher than 50 $W \cdot m^{-1} \cdot K^{-1}$, an even higher than 100, possibly higher than 200 $W \cdot m^{-1} \cdot K^{-1}$),
- secondly (for the main embodiment as depicted on FIG. 1-5), to the wings 83 (and possibly to the fins 97) which increase the heat exchange surface with the air,
- thirdly to the suspension 66 inside the diaphragm 49 and the lack of outer suspension, which induces:
  - on the one hand the increase of diameter of the heat producing movable coil 50, and hence its jutting out to the periphery of the transducer 3,
  - on the other hand the direct fixation of the waveguide 76 onto the yoke 36 (any outer peripheral suspension would have implied the interposition, between the waveguide 76 and the yoke 36, of a thermally insulating piece which would have lowered heat dissipation),
- fourthly, to the decrease of operation clearance between the movable coil 50 and the air gap 47 of the magnetic circuit 34, as a consequence of the preferred "floating" embodiment and in particular of the outer clearance, which decreases the thickness of the annular air layer (naturally insulating) between the movable coil 50 and the yoke 36 and increasing the conduction of heat from the movable coil 50 toward the waveguide 76 through the yoke 36.

Therefore, the heat accumulated in the secondary transducer 3 may be at least partly evacuated by radiation and convection, in front of the system 1. Practically, when the system 1 is fixed by the crown 20 of its basket 18 onto the vertical wall of a loudspeaker enclosure (whereby the axis is horizontal), the heat dissipated frontally by the waveguide 76 overheats the surrounding air which then tends to move up, thereby inducing an intake of fresh air and an upward convective air circulation movement which evacuates calories and ensures the cooling of the secondary transducer 3.

In the main embodiment, the thin and rounded shape of each wing 83, the side flanges 89 of which are, on the one hand, inclined from the base of the wing located on the side of the diaphragm (and carrying the central portion 82 of the back face 80) toward its front edge 85 and, on the other hand are connected to the horn initial section 86 by circular fillets 90, aims at minimizing the influence of the wings 83 on the acoustical radiation of the diaphragm 49.

Figure 9:
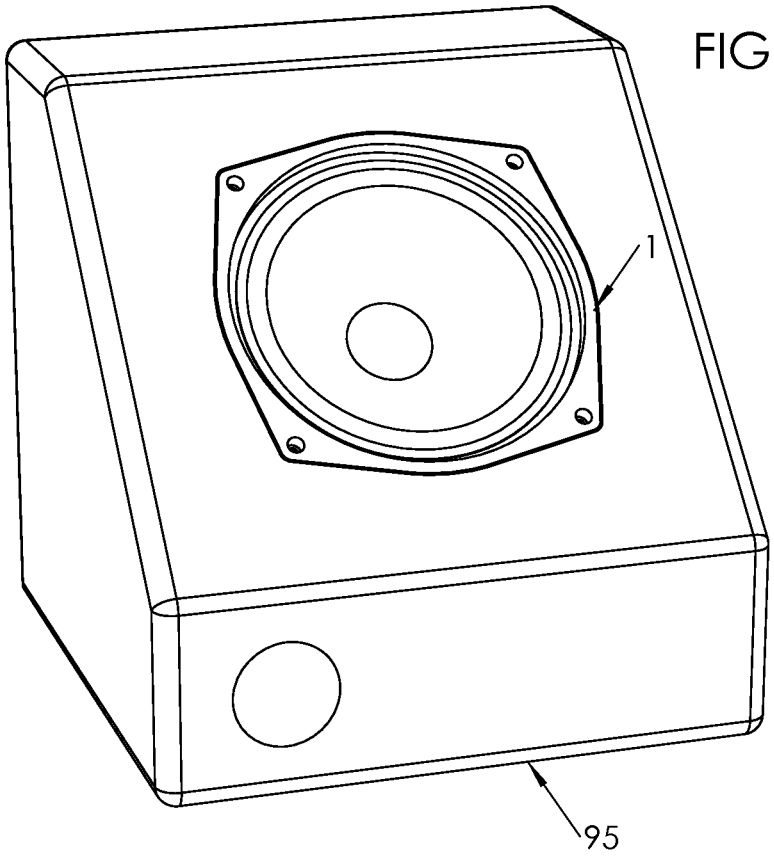
FIG. 9 is a perspective view showing a loudspeaker enclosure including a coaxial loudspeaker system as illustrated on FIG. 1.

The system 1 may be mounted on any type of loudspeaker enclosure, such a stage monitor loudspeaker 95, with an inclined front face, as in the depicted example of FIG. 9.

The invention claimed is:

1. A coaxial (1) two-way or more loudspeaker system comprising a main electro-dynamic transducer (2) for the reproduction of low range and/or mid range frequencies, including:

- a main magnetic circuit (4) defining a main air gap (17),
- a moving part (22) comprising a diaphragm (23) fixed to a movable coil (24) diving into the main air gap (17), said movable coil (24) comprising a support (26) and a solenoid (25) winded onto the support (26);
- wherein the system further comprises a secondary electro-dynamic transducer (3) for high range frequencies, mounted in a coaxial and frontal position with respect of the main electro-dynamic transducer (1), received within a space limited backwards by a front face (11) of a pole piece (6) of the main magnetic circuit (4), and laterally by the wall of the support (26) of the movable coil (24) and including:

a secondary magnetic circuit (34) distinct from the main magnetic circuit (4) and defining a secondary air gap (47), a moving part (48) comprising a diaphragm (49) fixed to a movable coil (50) diving into the secondary air gap (47), and a waveguide (76) forming a whole horn, mounted in the vicinity of the diaphragm (49), and having a face (80) facing and in the vicinity of the diaphragm and limiting a compression chamber (93), said waveguide (76) having a mouth (88) which extends further to a peripheral suspension (27) of the diaphragm (23) of the main transducer (2)

wherein the secondary transducer (3) further comprises a fixed endoskeleton (52), and wherein the moving part (48) of the secondary transducer is mounted to the endoskeleton (52) by an inner suspension (66) disposed inside the diaphragm (49), wherein the moving part (48) of the secondary transducer (3) is free of outer suspension outside the diaphragm (49).

2. Loudspeaker system (1) according to claim 1, wherein the transducers (2, 3) have coincidence, or almost coincident acoustical centers (C1, C2).

3. Loudspeaker system (1) according to claim 1, wherein the secondary transducer (3) is fixed to the main transducer (2) through its endoskeleton (52).

4. Loudspeaker system (1) according to claim 3, wherein the endoskeleton (52) comprises a plate (53) fixed to the secondary magnet circuit (34), and a rod (54) fixed to the plate (53) and through which the secondary transducer (3) is fixed to the main magnetic circuit (4).

5. Loudspeaker enclosure (95) including a coaxial loudspeaker system (1) according to claim 1.

* * * * *